US005226742A

United States Patent [19]

Pintar et al.

[11] Patent Number: 5,226,742

[45] Date of Patent: Jul. 13, 1993

[54] ELECTRICALLY POWERED PAPER STACKING APPARATUS AND METHOD FOR IMPACT PRINTERS AND THE LIKE

[75] Inventors: Robert R. Pintar, Eagle; John D. Taggart, Meridian; Thurman W. Wardlow, Eagle, all of Id.

[73] Assignee: Hewlett-Packard Company, Palo Alto, Calif.

[21] Appl. No.: 690,424

[22] Filed: Apr. 23, 1991

[51] Int. Cl.[5] ..... B41J 11/42

[52] U.S. Cl. ..... 400/583.4; 400/613.2; 400/616.2; 400/618

[58] Field of Search ..... 400/583, 583.4, 611, 400/613.2, 616, 616.2, 618, 619, 902, 583.3; 318/696

[56] References Cited

U.S. PATENT DOCUMENTS

| | | | |
|---|---|---|---|
| 2,906,527 | 9/1959 | Blain | 400/613.2 |
| 3,508,637 | 4/1970 | Hull et al. | 400/583.4 |
| 3,511,354 | 5/1970 | Barcomb et al. | 400/902 |
| 4,024,477 | 5/1977 | Epstein | 318/696 |
| 4,030,720 | 6/1977 | Jones | 400/583 |
| 4,226,410 | 10/1980 | McIntosh, Sr. et al. | 400/613.2 |

FOREIGN PATENT DOCUMENTS

| | | | |
|---|---|---|---|
| 137986 | 10/1980 | Japan | 400/583 |
| 155078 | 9/1984 | Japan | 400/902 |
| 195075 | 8/1989 | Japan | 400/583.4 |

*Primary Examiner*—David A. Wiecking

[57] ABSTRACT

Method, apparatus, system and circuitry for controlling the paper motion and accumulation at the output of a high speed impact printer or the like. The preferred embodiment includes means for providing stepped motion paper drive at the output of the printer which is synchronously controlled with respect to paper motion within the printer. This stepped motion drive is set at one stepping rate when a print bar of the impact printer is forming characters in a single line of print and this drive is periodically increased when the paper slews between lines of printed text. This novel paper drive technique operates to eliminate excessive pulling force on the paper, conserve print quality thereon, and simultaneously minimizes power consumption in the printer. The preferred embodiment of the invention also includes a new and improved paper stacking apparatus adapted for attachment to the paper feed output port of an impact printer, and a novel control system and novel implementing circuitry for providing precise stepper motor and paper drive control operative within this paper stacking apparatus for aiding in the uniform stacking fan fold paper which has been processed at high impact printing speeds. In addition, the above implementing circuitry is operative with a maximum of energy conservation, and the control system in which this circuitry is used is simultaneously operative with a minimum of power consumption.

12 Claims, 5 Drawing Sheets

ELECTRICALLY POWERED PAPER STACKING APPARATUS AND METHOD FOR IMPACT PRINTERS AND THE LIKE

TECHNICAL FIELD

This invention relates generally to the control of paper motion in impact printers and more particularly to an electrically driven paper stacker for enhancing continuous Z-fold paper stacking from high speed impact printers and for facilitating the ease of printer operation.

BACKGROUND ART

In the past, fan fold or Z-fold paper used in impact printers was moved by conventional drive mechanisms such as tractor rollers having pins thereon and operative to move into and out of contact with mating holes at the edges of the paper. Typically, the rotational velocity of these tractor rollers was directly controlled as a function of print speed using conventional closed loop feedback control system techniques. These tractor rollers would normally drive the printed paper along a predefined paper path and through an output feed port and paper shroud into a paper collection tray or bin attached to the printer.

Whereas the above prior art approach was entirely satisfactory for certain types of impact printing applications, it has not been particularly well suited for high speed impact printers and to handle variations in paper size. And in some cases, the above prior art approach has allowed an undesirable build-up of static electrical charge on the paper to the detriment of even and uniform paper stacking and accumulation at the output paper collection tray of the printer. In addition, these prior art paper drive and accumulation systems could not always be suitably adjusted to accommodate for a variety of form thicknesses, and printers employing such paper drive and accumulation systems were sometimes difficult to load and unload. Furthermore, known prior art paper stacking devices generally operate to the detriment of dot matrix print quality.

DISCLOSURE OF INVENTION

The general purpose and principal object of the present invention is to provide a new and improved electrically powered paper stacking apparatus and method of operation for use with high speed impact printers and the like. This apparatus and method have been developed to overcome most, if not all, of the above described disadvantages characteristic of known prior art paper stacking and accumulation systems, and it does so without degrading print quality.

Another object of this invention is to provide a new and improved paper stacking method and apparatus of the type described which is especially well suited for uniformly stacking fan fold paper which has just been processed through a high speed impact printer.

Another object of this invention is to provide a new and improved paper stacking method and apparatus of the type described which operates at all times to minimize power consumption.

Another object of this invention is to provide a new and improved electrically powered paper stacking apparatus and method of the type described which is operable to facilitate the ease of loading and unloading paper to and from the printer.

Another object of this invention is to provide a new and improved paper stacking method and apparatus of the type described which is relatively easy to assemble, reliable in construction and operation, and which may be retrofitted on existing printer designs.

The above purpose, related objects and novel features of this invention are accomplished by the provision of a novel method and apparatus for controlling the paper flow and paper accumulation in a printer of the type having a dot matrix hammer per column print bar perpendicular to the direction of paper movement through the printer. The method includes the steps of providing stepped motion drive at a powered paper stacking apparatus which is synchronously driven with respect to the printer paper drive system. A paper puller located at the output of the printer pulls the paper with optimized torque during character formation and printing, but this torque is increased while the paper is advancing between lines or unprinted regions on the paper. Using this approach, current to a stepper motor is boosted during such slewing of the paper between lines to provide greater pulling force on the paper at this time. The stepper motor and all of its associated electronics are turned off and are inactive when the printer is inactive, and the current control technique described hereinbelow reduces the total overall power consumption in the printer and eliminates excessive pulling forces on the paper processed therein.

A feature of this invention is the provision of a paper accumulation housing which is positioned adjacent to the printer housing of a high speed impact printer. This housing and paper stacking apparatus therein includes an output paper tray and drive roller means positioned between the output paper tray and the paper feed output port of the printer housing for providing a paper drive and pull on paper received from the paper feed output port of the printer housing to thereby drive the paper into the output paper tray.

Another feature of this invention is the provision of drive roller means including an idler assembly positioned on one side of a paper path within the paper accumulation housing and a drive roller positioned on the other side of the paper path within the paper accumulation housing and located adjacent to the idler assembly. The drive roller is cooperative with the idler assembly for driving paper from the printer housing into the output paper tray.

Another feature of this invention is the provision of two sets of chains positioned within the paper accumulation housing between the drive roller means therein and the output paper tray for thereby providing a flexible vertical paper transport path within the paper accumulation housing for allowing the paper to be uniformly stacked into the output paper tray. In this manner, a desired force is applied against perforations in the paper, thereby causing the paper to fold in the appropriate and normally folded direction. These door chains can be adjusted incrementally to accommodate a variety of paper form lengths.

Another feature of this invention is the provision of an idler roller which is positioned and mounted in the paper stacker housing so that it moves perpendicular to a fixed drive roller. The idler roller is pushed against the drive roller by means of two extension springs, giving the desired normal force to achieve optimum friction and rotational tractive force to a variety of paper thicknesses, and surface textures.

Another feature of the above described drive roller apparatus is that it automatically compensates for changes in form thickness. In addition, the drive and idler rollers are spaced so that as the width of the paper is increased, more and more rollers are contacted so as to increase the effective pull force on the paper.

Another feature of this invention is the provision of an output paper tray which comprises a paper receiving base member being positioned so as to have an angled paper receiving surface on which fan fold paper from the printer housing is received and uniformly stacked. The paper base is angled so that the paper will register against the adjustable paper backstop, thereby positioning the paper in an optimum location for defect free stacking. In addition, the paper backstop can be incrementally positioned so as to register the paper stack under the descending Z-fold paper and thereby accommodate a variety of form lengths and widths.

Another feature of this invention is the provision of a new and improved control system which is slaved off of the impact printer control system so as to precisely control a paper drive stepper motor at one torque value for character formation and at a higher torque value for paper slewing.

Another feature of this invention is the provision of a new and improved stepper motor drive system and control circuitry which a responsive to phase controlled input signals to drive center tapped motor transformer windings at high levels of voltage and current and at an adjustable chopping frequency and waveform.

Another feature of this invention is the provision of a paper drive system of the type described which is responsive to an input signal so as to control stepper motor torque, enhance transient response by providing a chopped high voltage power input, and improve the drive system efficiency by returning stored energy back to the power supply. This is accomplished by means of transformer action of the motor's center tapped windings and a novel series circuit return path to the power supply.

The above brief description of the invention, together with its many attendant advantages and novel features, will become better understood with reference to the following description of the accompanying drawings.

DETAILED DESCRIPTION OF THE PREFERRED EMBODIMENTS

Figure 1:
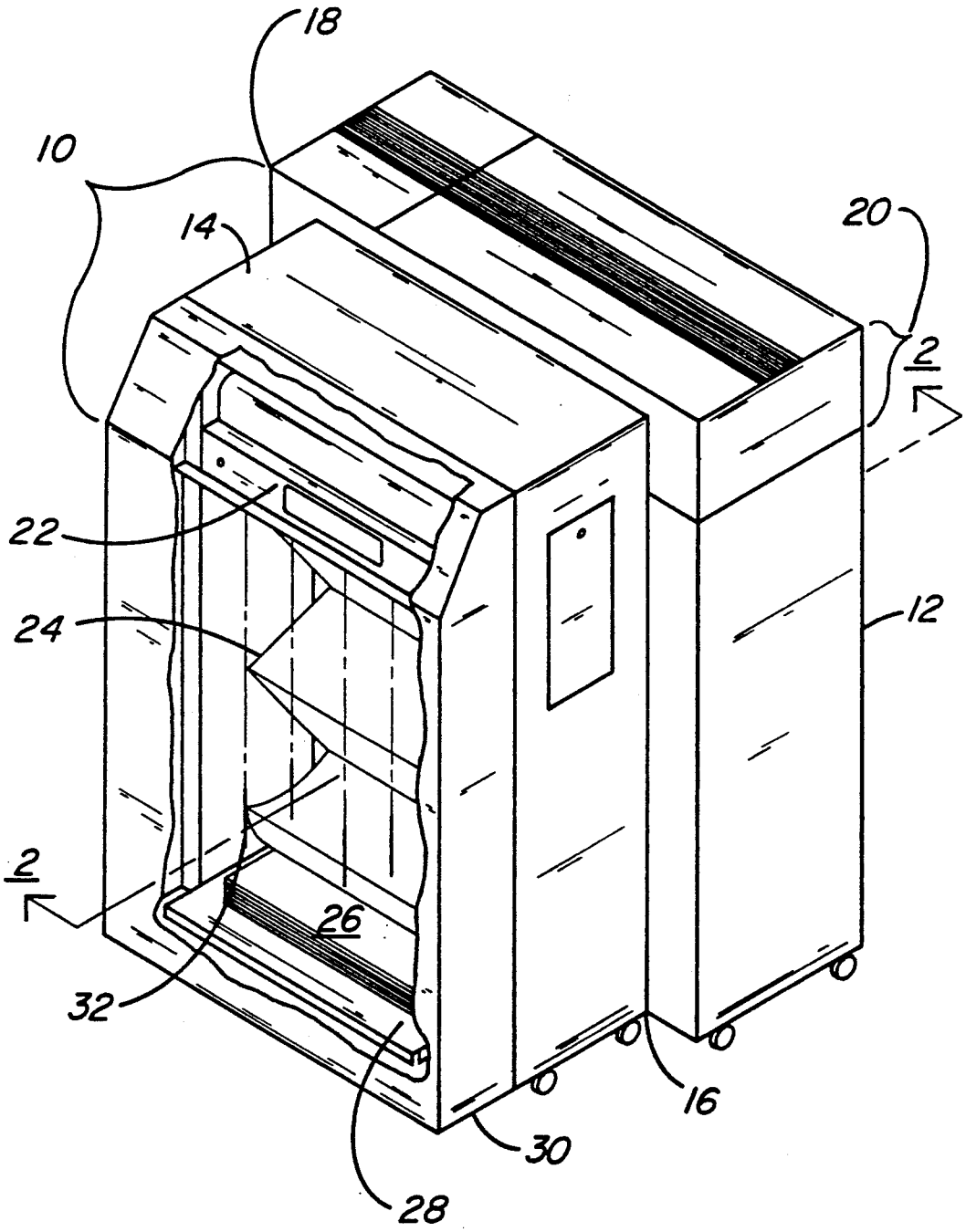
FIG. 1 is an isometric view of the powered paper stacker apparatus shown mounted immediately adjacent to the paper exit port of an impact printer.

Referring now to FIG. 1, the combination impact printer and powered paper stacker apparatus is designated generally as 10 and includes a high speed impact printer apparatus located within the upstanding printer housing 12. The powered paper stacker apparatus has been configured within the smaller housing 14 which has been constructed and positioned so that its back wall 16 abuts directly against an adjacent paper output wall 18 of the impact printer housing 12. The impact printer 12 includes a top cover portion 20 having a paper feed output port (not shown) which feeds directly into an opening (not shown) within the top portion of the back wall 16 of the paper stacker 14. The paper path between the impact printer 12 and paper stacker 14 and through these paper feed output and input ports is shown in more detail below with reference to FIG. 2.

The paper stacker 14 includes therein a paper drive mechanism (also described in FIG. 2 below) mounted within a shroud 22 from which the Z-fold or fan fold paper 24 descends into the paper stack 26 which is in turn supported by the paper base plate member 28.

Figure 2:
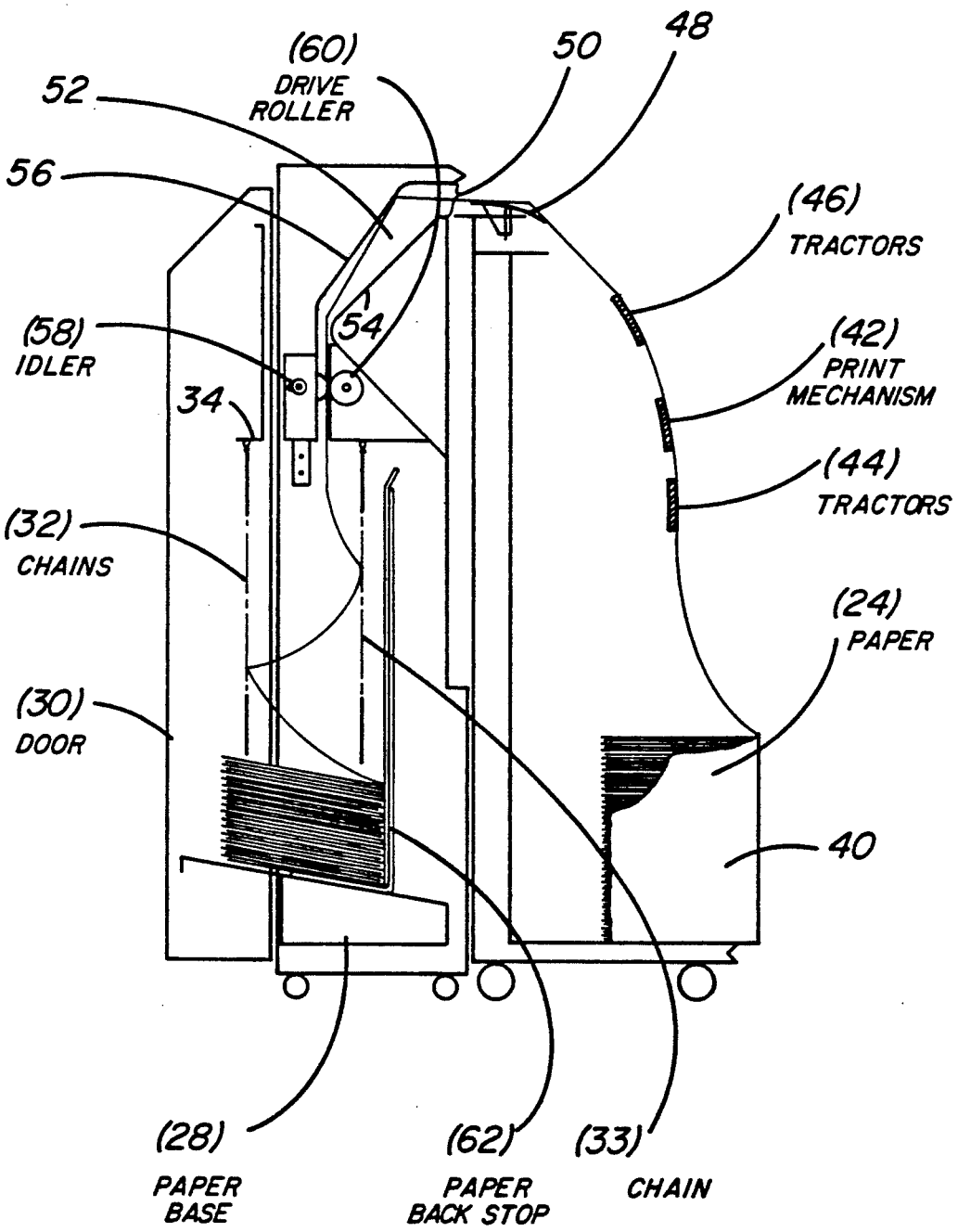
FIG. 2 is an abbreviated cross sectional view taken along lines 2—2 of FIG. 1.

The paper stacker apparatus 14 is further provided with a swinging door 30 having a set of five (5) chains 32 mounted as shown on an interior wall bracket 34 (see FIG. 2) on the inside panel 36 of the door 30. An identical set 33 of chains is shown in FIG. 2 and is mounted on the other side of the descending Z-fold paper path. The front panel of the door 30 further includes a rectangularly shaped window (not shown) which allows an operator to see if the paper stack 26 has been completed and is now ready for unloading. Thus, in operation, the paper drive mechanism mounted within the shroud 22 and described in more detail below with reference to FIG. 2 is operative to drive and uniformly stack the fan fold paper 24 on the paper base plate 28 as the Z-fold paper is received from the output paper feed port of the impact printer 12 at relatively high transport speeds on the order of 25 inches per second.

Referring now to FIG. 2, the high speed impact printer within the printing housing 12 will typically include an input paper tray or bin 40 located in the lower front section of the printer housing 12. The bin 40 is operative to supply the fan fold paper 24 to a high speed impact print mechanism 42 positioned as shown between a pair of tractors 44 and 46 operative for engaging the feed holes on the edges of the fan fold paper 24. Typically, in a line printer the print mechanism 42 will print all characters in one line at a time and in seven stepped segments beginning at the top of the characters in each line and ending at the bottom of the characters in each line. Then, the paper 24 is rapidly stepped to the position of the next line and then the above cycle is repeated all over again for all of the characters in the next line.

This line printing process thus requires that the seven segments of the characters in a single line be stepped at a first paper stepping speed, and thereafter the paper speed is increased as it is stepped more rapidly to advance the paper between adjacent printing lines and position the paper for receiving the impact print bar (not shown) at the next line to be printed. In this manner, the paper drive mechanism 58, 60 in the paper stacker 14 pulls the paper with optimized torque during character formation and printing and then pulls the paper with an increased torque when the printer 12 is advancing between lines or unprinted regions on the paper. During this operation, paper stacking in the paper stacker 14 is enhanced by properly synchronizing the paper transport speed with the print speed of the print bar within the print mechanism 42.

The Z-fold paper 24 passes over an upper paper guide 48 in the printer 12 and then into an opening 50 within the paper receiving shroud 22 of the paper stacker 14. The paper 24 continues to pass through the narrow passageway 52 between the facing walls 54 and 56 of the shroud 14 and then between an idler roller 58 and a fixed drive roller 60 mounted as shown within the paper receiving shroud 14. The drive roller 60 is driven by the stepper motor 82 described in further detail in FIG. 3 below and is operable to drive the paper between two sets of five (5) vertical chains 32 and 33 and into the output paper stack 26 which comes to rest on the upper surface of the paper receiving base plate 28.

The idler roller 58 and the fixed drive roller 60 cooperate to automatically compensate for changes in the thickness of the paper 24. The idler roller 58 is mounted and spring biased such that it moves perpendicular to the paper and is pushed against the drive roller 60 by means of two extension springs (not shown). This operation provides the desired normal force to the paper to achieve optimum friction and rotational tractive force to a variety of paper thicknesses and surface textures. The idler and drive rollers 58 and 60 are further operative to automatically compensate for changes in form width and are spaced and positioned so that as the width of the paper is increased, more and more rollers are contacted to thereby increase the effective pull force on the paper. These additional roller pairs like 58 and 60 in FIG. 2 are not seen in this figure, but are concentrically mounted on the same rotation shaft with the rollers 58 and 60 and are uniformly spaced across the width dimension of the Z-fold paper 24.

A set 32 of five (5) door chains and another set 33 of five (5) door chains are adjustable toward or away from the descending fan fold paper path 35. In this manner, a desired force is applied against the paper edge perforations, causing the paper to fold in the appropriate and normally folded direction. The two sets of door chains 32 and 33 can also be adjusted incrementally to accommodate a variety of paper form lengths.

The paper base plate 28 is angled so that the paper 24 will register against the adjustable paper back stop 62, thereby positioning the paper 24 in an optimum location for defect free stacking. The paper back stop 62 can also be incrementally positioned so as to register the paper stack 26 under the descending fan fold paper 24 and accommodate a variety of form lengths and widths.

Figure 3:
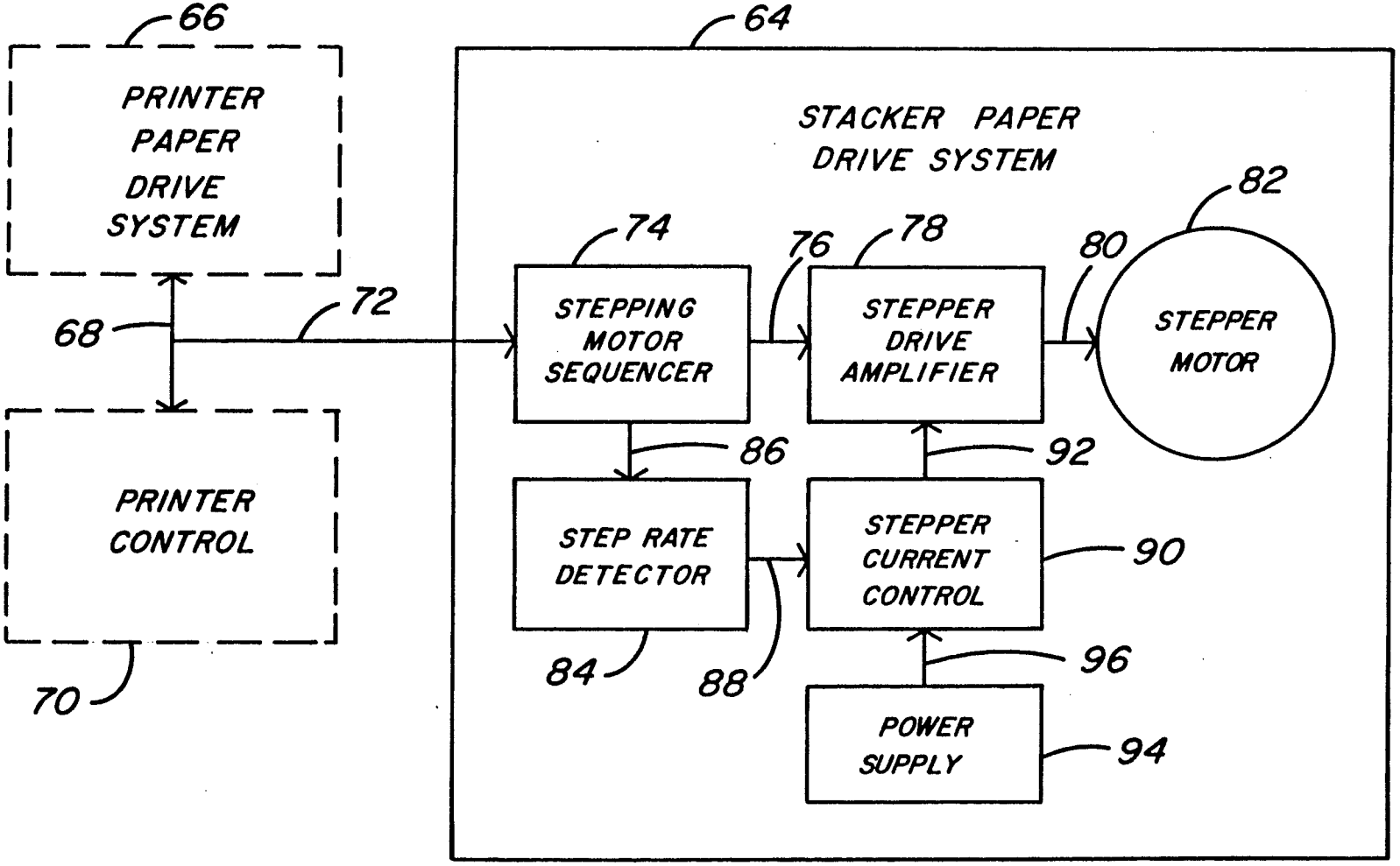
FIG. 3 is a functional block diagram of the paper stacker electrical drive system for the apparatus shown in FIGS. 1 and 2 above.

Referring now to the paper stacker drive system shown in the functional block diagram in FIG. 3, this paper drive system is indicated generally at 64 and is slaved off of the impact printer 12. The printer paper drive system 66 receives its information via line 68 from printer control 70, and this same control information is applied by way of line 72 to a stepping motor sequencer stage 74. The stepping motor sequencer stage 74 is in turn connected via line 76 to a stepper drive amplifier stage 78, and the output signals on line 80 from the stepper drive amplifier stage 78 are applied to a four phase stepper motor 82.

A step rate detector 84 is connected as shown to receive output data via line 86 from the stepping motor sequencer stage 74, and the step rate detector 84 determines the difference between forming a character within a line of printed characters and advancing or slewing the paper between adjacent printed lines. As the step rate of the detector 84 increases, the paper is being slewed between lines, and as the step rate of the detector 84 slows down, characters are being printed within a given line across the width of the paper. Therefore, the step rate detector 84 is in turn operative to generate an input control signal on line 88 which is applied to a stepper current control stage 90.

The stepper current control stage 90 in turn responds to the output signal on line 88 from the step rate detector 84 to adjust the input current on line 92 to the stepper drive amplifier 78 and thereby adjust the torque on the stepper motor 82. Thus, when the impact printer 12 is printing lines of characters, there is applied a small amount of torque to the stepper motor 82, and when the impact printer mechanism 42 is advancing between adjacent lines of characters, an increase torque to the paper 24 is provided by the operative combination of the idler roller 58 and the fixed drive roller 60, where the drive roller 60 in FIG. 2 is directly driven by the stepper motor 82 in FIG. 3. Thus, when the paper is slewing between lines, the torque applied to the drive roller 60 is approximately doubled to in turn provide a slew rate for the paper of approximately 25 inches per second.

Referring again to FIG. 2, although there is shown therein only a single idler roller 58 and a single fixed drive roller 60, these rollers will be increased as noted above as the width of the paper is increased. Normally, there will be about five (5) of these combination idler rollers and drive rollers spaced uniformly across the width of the paper 24. Each of these rollers 58, 60 spaced uniformly across the paper may be of different diameters, and this could happen as a result of variations in manufacturing tolerances. Thus, rollers with slightly larger diameters will tend to move the paper 24 faster than rollers with slightly smaller diameters. This in turn could cause the paper 24 to be driven at an undesirable skew angle with respect to the normal direction of paper travel within the impact printer 12. However, in order to compensate for this possible variation in roller diameter size and attendant paper skewing, the rollers 58 are driven by the stepper motor 82 at a speed of about 11% faster than the speed of the fan fold paper being received from the impact printer 12.

This action in turn causes the rollers 58 and 60 to slip on the surface of the driven paper 24, and as soon as the rollers 58 and 60 begin to slip, the paper 24 tends to realign itself, since the coefficient of dynamic friction is less the coefficient of static friction between the rollers and the paper 24. The drive rollers 60 are mounted as indicated above on a common shaft (not shown), and this shaft is driven by the stepper motor 82 as shown in FIG. 3. Thus, when the rollers 60 start to slip as the coefficient of friction changes from static to dynamic, the paper 24 tends to realign itself in a direction normal to the length dimension of the impact printhead mechanism 42.

Another reason for utilizing the above overdrive technique wherein the rollers 60 are driven at approximately 11% greater tangential velocity than the velocity of the paper 24 is that this overdrive technique will compensate for slippage due to the inertia of the paper during the starting and stopping motion thereof. If the latter feature were not provided, the paper 24 would tend to bunch up between the output of the impact printer 12 and the idler and drive rollers 58 and 60 in the paper stacker 14. This undesirable bunching of paper would in turn produce intolerable paper jams at the output of the impact printer 12.

Figure 4A:
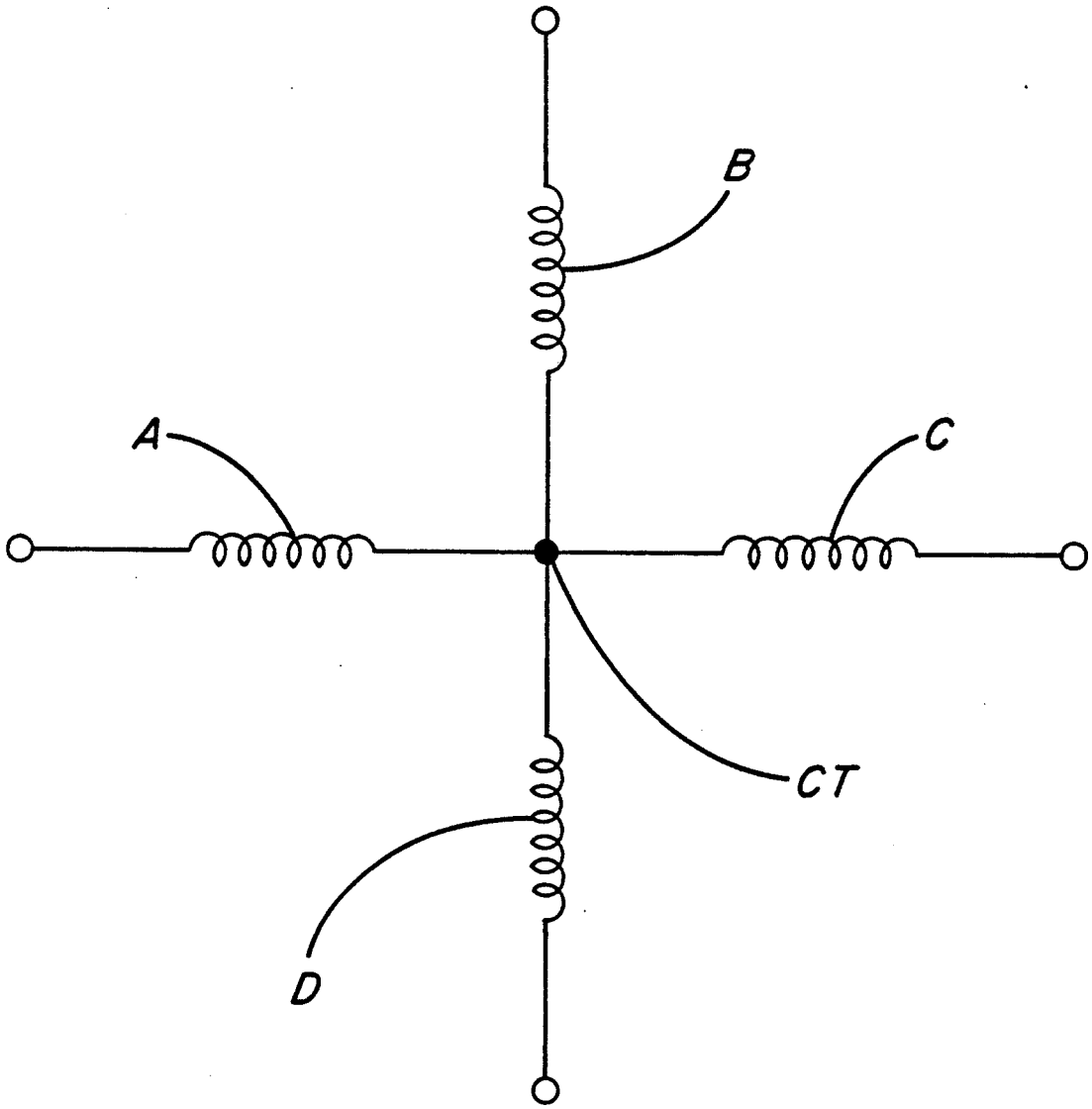
FIG. 4A is a schematic diagram of the winding connections for a four phase stepper motor useful in the drive system of FIG. 3.

Referring now to FIG. 4A, there is shown an abbreviated schematic winding diagram for a four phase stepper motor of the type used at 82 in FIG. 3. The stepper motor 82 in FIG. 3 is stepped sequentially by applying a voltage to the four phases or windings A through D in FIG. 4A, and a full step will result when a voltage is applied first to winding A, then removed and a voltage is applied to winding B. If the voltage is then removed from winding B and then applied to winding C, then another complete step results, and so on. The direction of the motor stepping may be reversed by sequentially applying voltages to the above windings A through D in the reverse order.

One basic problem with stepper motors of the type shown at 82 in FIG. 3 is in the inherent inductance of the motor windings. This inductance causes a relatively slow exponential increase in current in these windings when rated voltage is applied to the windings, and the energy stored in the resultant magnetic fields must be dissipated when the voltage is removed from the windings. Both of these effects result in a slowed motor response characteristic. In the past, these problems have been partially addressed by driving the stepper motor with a constant current source (which is very inefficient) or by shaping the drive voltage to the motor windings such that the applied voltage is high to start with and is reduced as the current in the windings approaches rated value. The energy stored in the motor windings was usually handled by dissipating it through a zener diode, which was also a very inefficient approach to the above problem.

However, in accordance with the present invention, both of these problems have been solved by driving the stepper motor 82 in FIG. 3 with a chopped voltage that is 10 to 20 times greater than the rated voltage for the motor windings. This operation has been successfully achieved by the construction and use of the novel stepper motor phase control circuitry shown in FIG. 4B and described below.

Figure 4B:
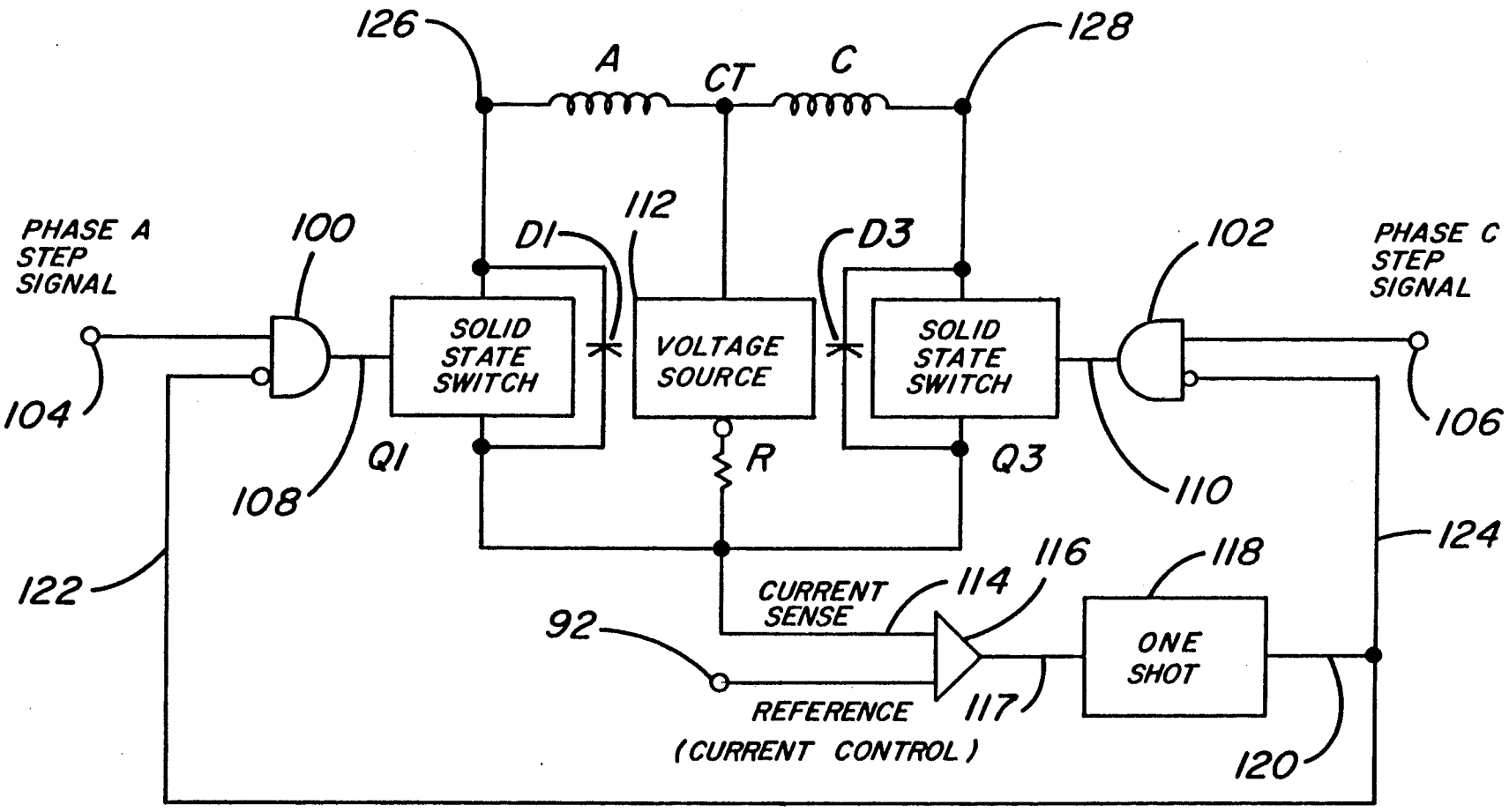
FIG. 4B is a schematic diagram of a preferred and novel circuit implementation for the stepper drive amplifier in FIG. 3 used for driving the stepper motor of the powered paper stacker shown in FIGS. 1 and 2.

Referring now to FIG. 4B, this control circuitry is representative of two identical control circuits which are employed in the stepper drive amplifier stage 78 shown in FIG. 3. In FIG. 3, the functional interconnect line 76 between the stepping motor sequencer stage 74 and the stepper drive amplifier stage 78 is in fact functionally representative of four individual wire connections, two of which are applied as phase control input signals A and C to the input gates 100 and 102 of FIG. 4B. The other two outputs (not individually shown) from the stepping motor sequencer stage 74 and also represented functionally at 76 in FIG. 3 will be applied in a similar manner to the two other inputs B and D of a phase control circuit (not shown) which is identical to the circuit shown in FIG. 4B. Thus, the circuit shown in FIG. 4B controls the voltage applied and current through the stepper motor windings A and C of FIG. 4A, whereas the identical (not shown) circuit will control the voltage and current applied to the stepper motor windings B and D as shown in FIG. 4A. Thus, the phase A step signal from stage 74 is applied as one input on line 104 to one input gate 100, whereas the phase C step input signal from the stepping motor sequencer stage 74 is applied as another out-of-phase input on line 106 to the other identical input gate 102.

The input gate 100 has its output line 108 connected to a solid state switch Q1, such as a transistor, whereas the other input gate 102 has its output line 110 connected to another solid state switch Q3. The switch Q1 is connected as shown in parallel with a clamping and bypass diode, D1, whereas the solid state switch Q3 is connected in parallel with a similar clamping and bypass diode D3.

The two solid state switches Q1 and Q3 are further connected as shown to opposite ends, respectively, of the two transformer windings A and C which are in turn connected to a center tap CT. The center tap CT is further connected to one side of a voltage source 112, and the voltage source 112 is connected on its other side through a current sensing resistor R to one input 114 of an operational amplifier 116. The operational amplifier 116 is in turn connected at its output 117 to drive a one shot multivibrator 118 whose output 120 is connected to both the second inputs 122 and 124 of the two input gates 100 and 102, respectively. The operational amplifier 116 is further connected at node 92 to the output of the stepper current control stage 90 in FIG. 3, and the operational amplifier stage 116 will be switched in response to the differential signal applied between lines 92 and 114 in the manner described below.

Since the phase A and phase C signals applied to the gates 100 and 102, respectively, are 180° out of phase, these two gates 100 and 102 will be alternately switched into and out of conduction to in turn alternately drive the solid state switches Q1 and Q3 to conduction once every 360° electrical degrees of the four phase motor 82 shown in FIG. 3. One four phase cycle of the stepper motor 82 will in turn produce 7.2 degrees of mechanical rotation for the drive shaft of the motor 82. The voltage applied to phase winding A and developed by current through the solid state switch Q1 is 10 to 20 times greater than the rated voltage for the A through D transformer windings, and accordingly, current through the A winding will build up 10 to 20 times faster than would otherwise be the case. When the current through the A winding reaches rated value, it is sensed by the voltage drop developed across the current sensing resistor R. At this point, the voltage developed across the current sensing resistor R and applied on the line 114 to the operational amplifier 116 will exceed the voltage on line 92 and thereby cause the operational amplifier 116 to be differentially switched, causing the one shot multivibrator stage 118 to fire and produce a signal on line 122 at the input gate 100 which causes switch Q1 to turn off for a predetermined period of time.

The two input AND gates 100 and 102 in the switching circuit of FIG. 4B are connected such when the output voltage on line 120 from the one shot multivibrator 118 is low, producing a negative "true" on both lines 122 and 124, then the one of the phase A or phase C signals that is high at the other inputs 104 and 106 to these two gates will cause lines 108 and 110 to alternately be driven high and in turn switch either Q1 or Q3 into conduction. However, when the one shot multivibrator 120 is driven high for a predetermined time duration by the voltage on line 114 exceeding the reference voltage on line 92, then conduction in both of these AND gates 100 and 102 will be blocked for this predetermined period of time until the one shot stage 118 is again turned off.

When Q1 turns off, the collapsing magnetic field in the motor winding A will generate a voltage that tries to maintain the current flowing in this winding. This voltage in turn will tend to make the voltage at point 126 positive with respect to the center tap point CT. However, this same voltage is also induced in the motor winding C, but of opposite polarity and thereby making the center tap point CT positive with respect to node 128. This action in turn causes a current to flow through the diode D3 connected across switch Q3, thereby transferring the current that was flowing in motor winding A to an opposite current flowing in motor winding C and then flowing back into the voltage source 112, thereby returning the energy stored in these windings A and C back to the voltage source 112.

The solid state switch Q1 might, for example, be an NPN transistor (not shown) which is operative to be switched into conduction when a positive going signal is received on line 108 from the gate 100. During this time, current will flow from the voltage source 112 and through the A winding and then down into the Q1 NPN transistor as viewed in FIG. 4B. However, when Q1 is subsequently turned off by the switching action described above the A winding will now act to source current in the reverse direction into the voltage source 112, through the resistor R, through the bypass or clamping diode D3, and finally through the C winding and back into the voltage source 112 to thereby maximize the conservation of energy in this switching circuit. This novel switching action is to be contrasted to known switching circuits of the prior art where this reverse current produced by the A winding when Q1 turns off would simply be dissipated through a resistor or zener diode to ground, thereby wasting this energy which is now conserved in accordance with the novel teachings of the present invention.

The one shot multivibrator 118 is timed so its switching duration is equal the time required for the current to reach rated value in each of the motor windings A through D, thereby allowing the same amount of time for the stored energy in these windings A and C to be returned to the power supply 112. During the time the stored energy in these windings A and C is being returned to the power supply 112, the current that was transferred from winding A to winding C is also maintaining the torque required on the stepper motor 82 in FIG. 3. This is true since the current flowing in the opposite direction through winding C has the same effect on this torque as current flowing in the forward direction through winding A.

The level of current through the stepper motor windings A through D can be controlled by adjusting the reference signal applied on line 92 at the reference input to the operational amplifier 116, and may be varied for different torque requirements for specific and unique circuit response requirements for a given stepper motor application. For example, for some stepper motor applications it might be desirable to provide a variable reference voltage waveform on the reference voltage line 92 against which the switches Q1 and Q3 in FIG. 4A can be timed and switched to in turn generate a replication of the variable reference voltage waveform across the four (4) motor windings A through D. In this manner, the current and voltage build up and decay in these motor windings can be uniquely controlled for various and different stepper motor requirements and response characteristics.

Various other modifications may be made in and to the above described embodiments without departing from the spirit and scope of this invention. Accordingly, any and all design and constructional modifications in both the apparatus, methods of operation, control system, and implementing circuitry described herein are clearly within the scope of the following appended claims.

We claim:

1. A printing and stacking apparatus including, in combination:

a. a printer housing including means therein for receiving a stack of unprinted fan fold paper, and means for passing paper past a print area for printing text or graphics thereon and then passing said paper to a paper feed output port, b. A paper accumulation housing positioned adjacent to said printer housing and including an output paper tray therein and further including drive roller means positioned between said output paper tray and said paper feed output port of said printer housing for providing a paper drive and pull on paper received from said paper feed output port of said printer housing to thereby drive said paper into said output paper tray, c. means for providing stepped motion drive at the output of said printer and being controlled by a drive current and pull force which is synchronously controlled with respect to paper motion in said printer, and d. means controlling said stepped motion drive for increasing the drive current and pull force on said paper when said paper slews between adjacent lines of printed text on paper moving through said printer.

2. The apparatus defined in claim 1 wherein said drive roller means includes an idler assembly positioned on one side of a paper path within said paper accumulation housing and a drive roller positioned on the other side of said paper path within said paper accumulation housing and located adjacent to said idler assembly and cooperative with said idler assembly for driving paper from said printer housing into said output paper tray.

3. The apparatus defined in claim 1 which further includes a set of chains positioned within said paper accumulation housing and between said drive roller means therein and said output paper tray for thereby providing a flexible vertical paper transport path within said paper accumulation housing for aiding said paper to be uniformly stacked into said output paper tray.

4. The apparatus defined in claim 3 wherein said drive roller means includes an idler assembly positioned on one side of a paper path within said paper accumulation housing and a drive roller positioned on the other side of said paper path within said paper accumulation housing and located adjacent to said idler assembly and cooperative with said idler assembly for driving paper from said printer housing into said output paper tray.

5. The apparatus defined in claim 1 wherein said printer housing includes:

a. a first tractor means positioned adjacent one surface of said printer housing and between said print area and said stack of unprinted fan fold paper for driving said paper toward said print area, b. a print mechanism within said print area for printing text or graphics on paper passing adjacent thereto, and c. a second tractor means positioned between said print mechanism and said paper feed output port for driving said paper through said paper feed output port and into said paper accumulation housing.

6. The apparatus defined in claim 5 wherein said drive roller means includes an idler assembly positioned on one side of a paper path within said paper accumulation housing and a drive roller positioned on the other side of said paper path within said paper accumulation housing and located adjacent to said idler assembly and cooperative with said idler assembly for driving paper from said printer housing into said output paper tray.

7. The apparatus defined in claim 6 which further includes a set of chains positioned within said paper accumulation housing and between said drive roller means therein and said output paper tray for thereby providing a flexible vertical paper transport path within said paper accumulation housing for aiding said paper to be uniformly stacked into said output paper tray.

8. The apparatus defined in claim 7 wherein said output paper tray comprises a paper receiving base member being positioned so as to have an angled paper receiving surface on which fan fold paper from said printer housing is received and uniformly stacked after passing between said set of chains.

9. A method for controlling stacking motion of paper at the output of a printer which includes the steps of:

a. generating control signals for controlling the motion and acceleration and deceleration of paper passing through a printer paper drive system, and b. simultaneously applying said control signals to said printer paper drive system and to a stacker paper drive system and causing the motion of paper stacking at the output of said printer to be synchronized with the acceleration and deceleration of paper motion in said printer paper drive system and passing through said printer.

10. A system and apparatus for controlling the stacking of paper at the output of a printer including a mechanism including a paper feed motor which drives the paper for printing and also includes a paper stacking device with its own motor which is controlled in both speed and torque as a direct result of the speed at which the paper is fed through the printer by the paper feed motor, said apparatus, in combination:

a. means for generating control signals for controlling the acceleration and deceleration of paper motion passing through a printer paper drive system and through a printer associated therewith, and b. means for simultaneously applying said control signals to said printer paper drive system and to a stacker paper drive system whereby excessive pulling forces on said paper at the output of said printer is eliminated and the stacking of paper in said stacker paper drive system is synchronized with the acceleration and deceleration of paper motion in said printer paper drive system and passing through said printer.

11. The system defined in claim 10 wherein said stacker paper drive system includes, in combination:

a. a stepping motor sequencer stage connected to a printer control means for said printer and responsive to control signals received from said printer control means, and b. stepper drive amplifier means connected between said stepping motor sequencer stage and a paper drive stepping motor and responsive to signals generated by said printer control means for driving transformer windings of said stepper motor.

12. The system defined in claim 11 wherein said stacker paper drive system further includes:

a. a step rate detector connected to an output of said stepping motor sequence stage, and b. a stepper current control stage connected between said step rate detector and said stepper drive amplifier means for controlling both current and voltage levels of said stepper drive amplifier means.

* * * * *